US011633761B2

(12) United States Patent
Ishii et al.

(10) Patent No.: US 11,633,761 B2
(45) Date of Patent: Apr. 25, 2023

(54) DRIVING APPARATUS, VIBRATION GENERATING APPARATUS, ELECTRONIC APPARATUS, AND DRIVING METHOD

(71) Applicant: TAIYO YUDEN CO., LTD., Tokyo (JP)

(72) Inventors: Shigeo Ishii, Tokyo (JP); Takayuki Goto, Tokyo (JP); Sumiaki Kishimoto, Tokyo (JP); Hiroyuki Shimizu, Tokyo (JP); Yuichi Namikawa, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 155 days.

(21) Appl. No.: 16/952,506

(22) Filed: Nov. 19, 2020

(65) Prior Publication Data

US 2021/0162458 A1 Jun. 3, 2021

(30) Foreign Application Priority Data

Nov. 28, 2019 (JP) ..... JP2019-215045

(51) Int. Cl.
*B06B 1/02* (2006.01)
*G08B 6/00* (2006.01)

(52) U.S. Cl.
CPC ..... *B06B 1/0238* (2013.01); *G08B 6/00* (2013.01); *B06B 2201/55* (2013.01)

(58) Field of Classification Search
CPC ..... B60B 1/0238; G08B 6/00; B06B 2201/55
USPC ..... 310/317
See application file for complete search history.

(56) References Cited

U.S. PATENT DOCUMENTS

2006/0082253 A1* 4/2006 Hara ..... H02N 2/062 310/317
2011/0178441 A1* 7/2011 Tyler ..... A61B 5/0036 601/2
2015/0231408 A1* 8/2015 Williams ..... A61N 5/06 607/88
2019/0154439 A1* 5/2019 Binder ..... G01B 11/26
2019/0247662 A1* 8/2019 Poltroak ..... A61B 5/0816
2021/0035420 A1* 2/2021 Urzhumov ..... B06B 1/16
2021/0162458 A1* 6/2021 Ishii ..... B06B 1/0238
2022/0273907 A1* 9/2022 Poltorak ..... A61B 5/165

FOREIGN PATENT DOCUMENTS

JP H08-314369 A 11/1996

* cited by examiner

*Primary Examiner* — Jack K Wang
(74) *Attorney, Agent, or Firm* — Chen Yoshimura LLP

(57) ABSTRACT

Provided is a driving apparatus that sets a signal wave in a low-frequency region having a frequency of 10 Hz or more and 250 Hz or less as a modulating wave and outputs to a piezoelectric actuator a driving signal having a waveform obtained by modulating an amplitude of a sine wave in a high-frequency region having a frequency of 20 kHz or more and 40 kHz or less with the modulating wave.

4 Claims, 5 Drawing Sheets

DRIVING APPARATUS, VIBRATION GENERATING APPARATUS, ELECTRONIC APPARATUS, AND DRIVING METHOD

BACKGROUND ART

The present disclosure relates to a driving apparatus, a vibration generating apparatus, an electronic apparatus, and a driving method which are associated with tactile sense presentation using vibrations.

Various actuators are used in tactile function devices that present tactile senses to users. For example, an electromagnetic actuator such as an eccentric motor and a linear resonant actuator is used for a notification function. Moreover, in addition to these electromagnetic actuators, piezoelectric actuators are also used for a force feedback function.

In recent years, the tactile sense technology has been advanced. Regarding the force feedback function in the low-frequency region (100 to 2250 Hz), a wider variety of tactile sense expressions has been provided by complex addition, modulation, and the like of driving signals. Moreover, regarding the high-frequency region (approximately 20 to 40 kHz), a technology by which a tactile sense such as a "rough" texture and a "smooth" texture can be presented has been developed (e.g., see Patent Literature 1).

SUMMARY OF THE INVENTION

As described above, new tactile senses can be presented to users by using vibrations in the high-frequency region (approximately 20 to 40 kHz). However, for generating a vibration in the high-frequency region, it is necessary to operate a piezoelectric actuator at high speed. There are thus problems of an increase in power consumption, heat generation, noise generation, and the like of the piezoelectric actuator.

In view of the above-mentioned circumstances, it is desirable to provide a driving apparatus, a vibration generating apparatus, an electronic apparatus, and a driving method, by which a new tactile sense can be presented while reducing problems caused by a high-frequency vibration of a piezoelectric actuator.

According to an embodiment of the present disclosure, there is provided a driving apparatus that sets a signal wave in a low-frequency region having a frequency of 10 Hz or more and 250 Hz or less as a modulating wave and outputs to a piezoelectric actuator a driving signal having a waveform obtained by modulating an amplitude of a sine wave in a high-frequency region having a frequency of 20 kHz or more and 40 kHz or less with the modulating wave.

With this configuration, by setting the signal wave in the low-frequency region as the modulating wave and outputting to the piezoelectric actuator the driving signal having the waveform obtained by modulating the amplitude of the sine wave in the high-frequency region with the modulating wave, it is possible to cause the vibrating member to produce a new tactile sense and to prevent the generation of noise while reducing the power consumption and heat generation of the piezoelectric actuator.

In the driving apparatus, the sine wave may be set to have voltage gain of −10 dB or more and 0 dB or less and the modulating wave may be set to have voltage gain of −6 dB or more and 0 dB or less.

In the driving apparatus, the sine wave may be set to have voltage gain of −10 dB, and the modulating wave may be set to have voltage gain of 0 dB.

According to an embodiment of the present disclosure, there is provided a vibration generating apparatus including a vibrating member, a piezoelectric actuator, and a driving apparatus.

The piezoelectric actuator is bonded to the vibrating member.

The driving apparatus sets a signal wave in a low-frequency region having a frequency of 10 Hz or more and 250 Hz or less as a modulating wave and outputs to the piezoelectric actuator a driving signal having a waveform obtained by modulating an amplitude of a sine wave in a high-frequency region having a frequency of 20 kHz or more and 40 kHz or less with the modulating wave, thereby causing the vibrating member to vibrate via the piezoelectric actuator driven by the driving signal.

According to an embodiment of the present disclosure, there is provided an electronic apparatus including a vibration generating apparatus and an electronic component connected to the vibration generating apparatus. The vibration generating apparatus includes a vibrating member, a piezoelectric actuator bonded to the vibrating member, and a driving apparatus that sets a signal wave in a low-frequency region having a frequency of 10 Hz or more and 250 Hz or less as a modulating wave and outputs to the piezoelectric actuator a driving signal having a waveform obtained by modulating an amplitude of a sine wave in a high-frequency region having a frequency of 20 kHz or more and 40 kHz or less with the modulating wave, thereby causing the vibrating member to vibrate via the piezoelectric actuator driven by the driving signal.

According to an embodiment of the present disclosure, there is provided a driving method including: setting a signal wave in a low-frequency region having a frequency of 10 Hz or more and 250 Hz or less as a modulating wave; and outputting to a piezoelectric actuator a driving signal having a waveform obtained by modulating an amplitude of a sine wave in a high-frequency region having a frequency of 20 kHz or more and 40 kHz or less with the modulating wave.

As described above, in accordance with the present disclosure, it is possible to provide a driving apparatus, a vibration generating apparatus, an electronic apparatus, and a driving method, by which a new tactile sense can be presented while reducing problems caused by a high-frequency vibration of a piezoelectric actuator.

These and other objects, features and advantages of the present disclosure will become more apparent in light of the following detailed description of embodiments thereof, as illustrated in the accompanying drawings. It is to be understood that both the foregoing general description and the following detailed description are exemplary and explanatory, and are intended to provide further explanation of the disclosure as claimed.

DETAILED DESCRIPTION OF THE EMBODIMENTS

A vibration generating apparatus according to an embodiment of the present disclosure will be described. It should be noted that in each of the figures shown below, the X direction, the Y direction, and the Z direction are three directions orthogonal to one another.

[Configuration of Vibration Generating Apparatus]

Figure 1:
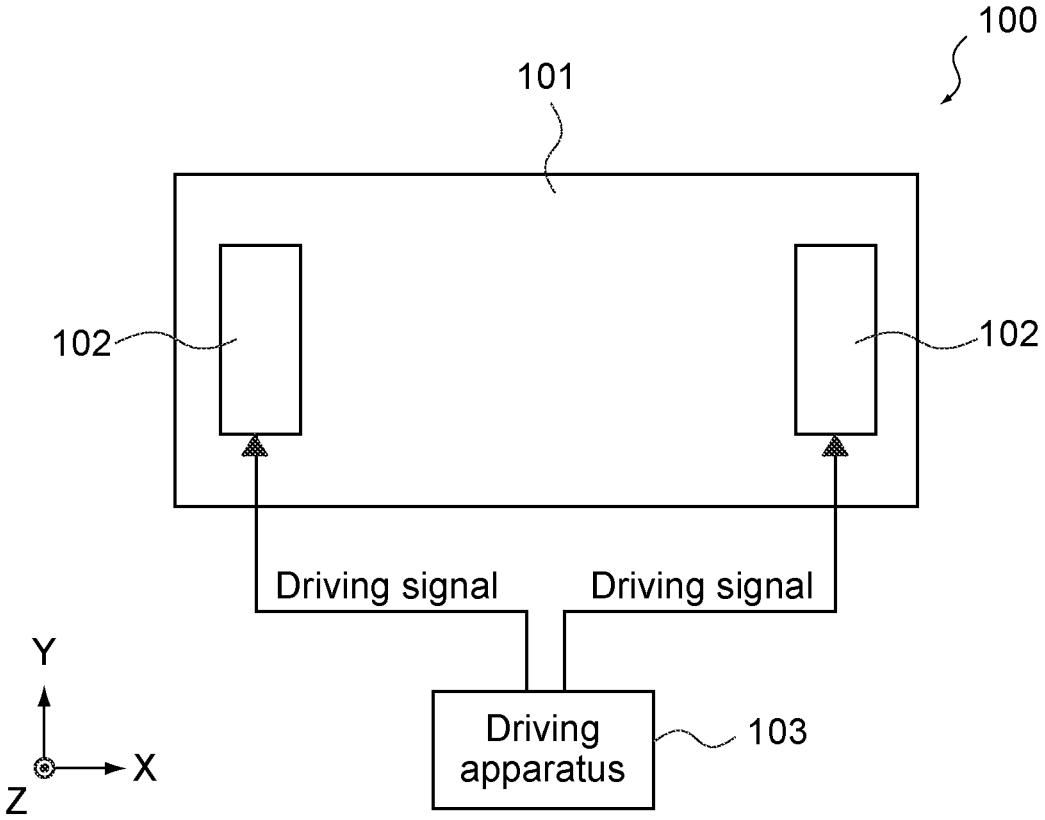
FIG. 1 is a schematic diagram of a vibration generating apparatus according to an embodiment of the present disclosure.

FIG. 1 is a schematic diagram of a vibration generating apparatus 100 according to this embodiment. As shown in the figure, the vibration generating apparatus 100 includes a vibrating member 101, piezoelectric actuators 102, and a driving apparatus 103.

Figure 2:
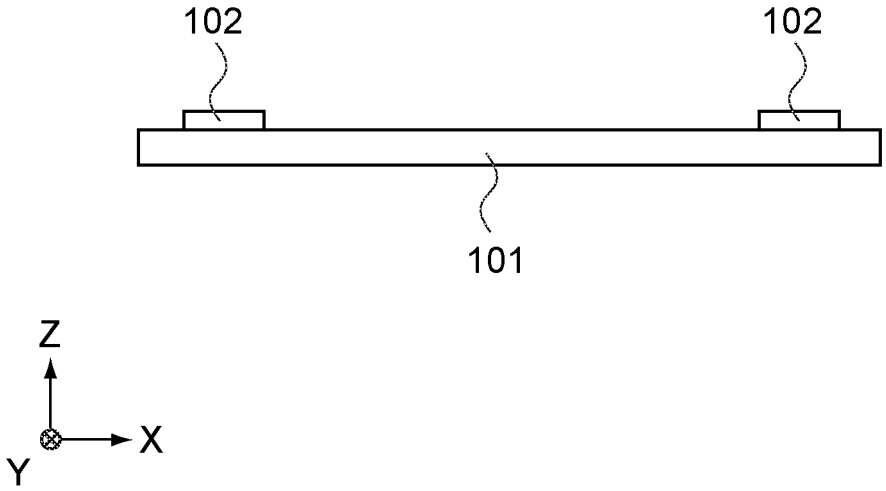
FIG. 2 is a plan view of a vibrating member and piezoelectric actuators provided in the vibration generating apparatus.

The vibrating member 101 is a member vibrated by the piezoelectric actuators 102. FIG. 2 is a side view of the vibrating member 101. The vibrating member 101 can be a plate-like member formed from materials such as glass and plastic, and is, for example, a liquid-crystal panel, a casing of an electronic apparatus, or the like. The vibrating member 101 is not particularly limited to the shape and size of the vibrating member 101.

The piezoelectric actuators 102 are bonded to the vibrating member 101 to generate vibrations. The piezoelectric actuators 102 each include a positive electrode, a negative electrode, and a piezoelectric material layer. When a voltage is applied between the positive electrode and the negative electrode, the piezoelectric material layer is deformed due to the reverse piezoelectric effect, such that a vibration is generated. The piezoelectric actuators 102 may each have a laminated structure in which positive electrodes and negative electrodes are alternately laminated with piezoelectric material layers each interposed therebetween. Alternatively, the piezoelectric actuators 102 may have another structure.

As shown in FIG. 2, the piezoelectric actuator 102 can be disposed at each of opposite end portions of the vibrating member 101 in a long side direction (x direction). Moreover, the number of the piezoelectric actuators 10 is not limited to two, and one or three or more piezoelectric actuators 10 may be disposed. The piezoelectric actuators 102 can be joined to the vibrating member 101 by bonding or the like.

The driving apparatus 103 outputs driving signals to the piezoelectric actuators 102. The driving apparatus 103 is connected to the positive electrodes and the negative electrodes of the piezoelectric actuators 102 and outputs voltage waveforms to be described later between the positive electrodes and the negative electrodes as the driving signals. The driving apparatus 103 is, for example, an amplifier.

The vibration generating apparatus 100 has the above-mentioned configuration. The vibration generating apparatus 100 can be mounted on various electronic apparatuses such as a smartphone and a tactile function device having other electronic components.

[Regarding Driving Signal]

The waveforms of the driving signals output from the driving apparatus 103 to the piezoelectric actuators 102 will be described. It should be noted that a sine wave is used as a signal wave in a low-frequency region for the sake of convenience in the following description, though not limited thereto.

Figure 3:
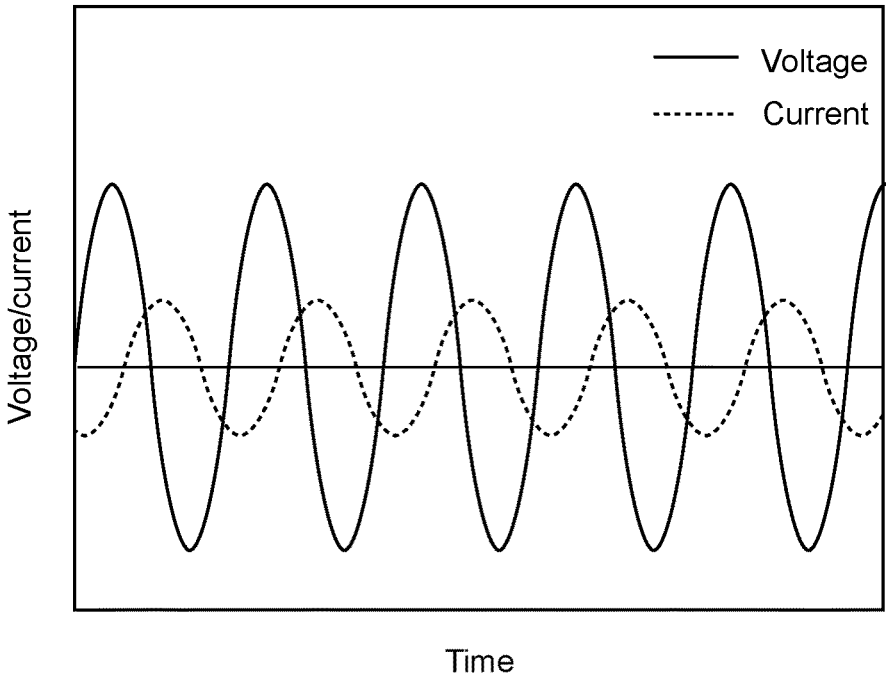
FIG. 3 shows a high-frequency wave waveform generated by a driving apparatus provided in the vibration generating apparatus.

FIG. 3 shows a voltage waveform and a current waveform as a sine wave in a high-frequency region having a frequency of 20 kHz or more and 40 kHz or less. When the voltage waveform shown in FIG. 3 is applied from the driving apparatus 103 to each of the piezoelectric actuators 102 as the driving signal, current having the current waveform shown in FIG. 3 flows.

Thus, in a case where the sine waves in the high-frequency region are used as the driving signals, ultrasonic standing waves are formed in the vibrating member 101 and a levitation phenomenon due to the ultrasonic standing waves occurs when the user touches the vibrating member 101. Accordingly, when the user slides a finger on the vibrating member 101, the user can feel a tactile sense such as a "smooth" texture and a "rough" texture.

However, in a case where such sine waves in the high-frequency region are used as the driving signals, the driving current of the piezoelectric actuators 102 increases and the power consumption increases. Moreover, the heat generation of the piezoelectric actuators 102 also increases. In addition, noise may be generated between the user's finger and the vibrating member 101.

Figure 4:
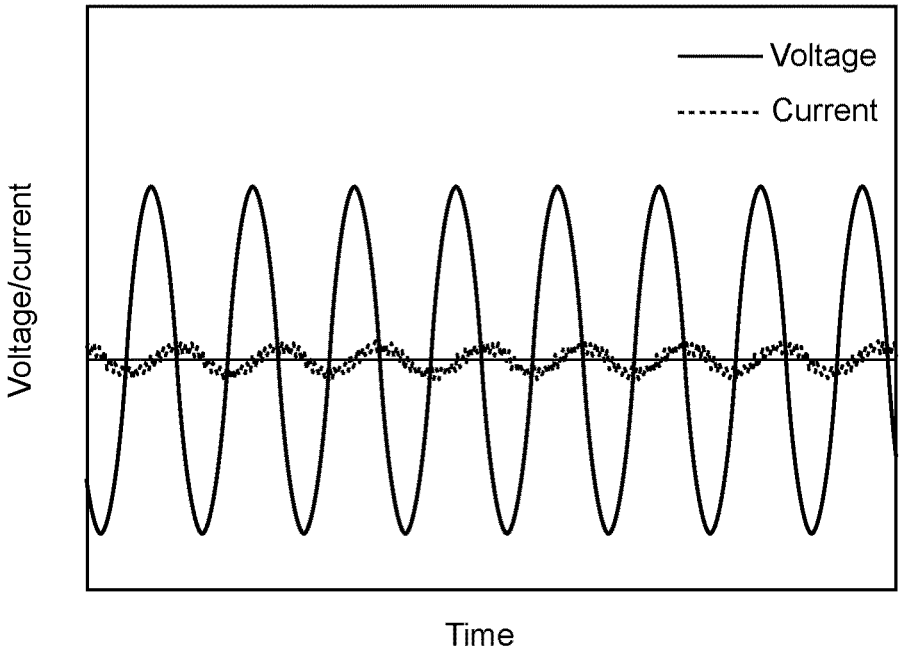
FIG. 4 shows a low-frequency wave waveform generated by the driving apparatus provided in the vibration generating apparatus.

FIG. 4 shows a voltage waveform and a current waveform as a sine wave in the low-frequency region having a frequency of 10 Hz or more and 250 Hz or less. When the voltage waveform shown in FIG. 4 is applied from the driving apparatus 103 to each of the piezoelectric actuators 102 as the driving signal, current having the current waveform shown in FIG. 4 flows.

The vibration in the low-frequency region of 10 Hz or more and 250 Hz or less is a vibration that can be easily sensed by Meissner's corpuscles, Pacinian corpuscles, and the like, which are mechanoceptors in human skin. When such sine waves in the low-frequency region are used as the driving signals, standing waves are formed in the vibrating member 101 and the user can feel a sense such as a vibration and an electrical shock.

Figure 5:
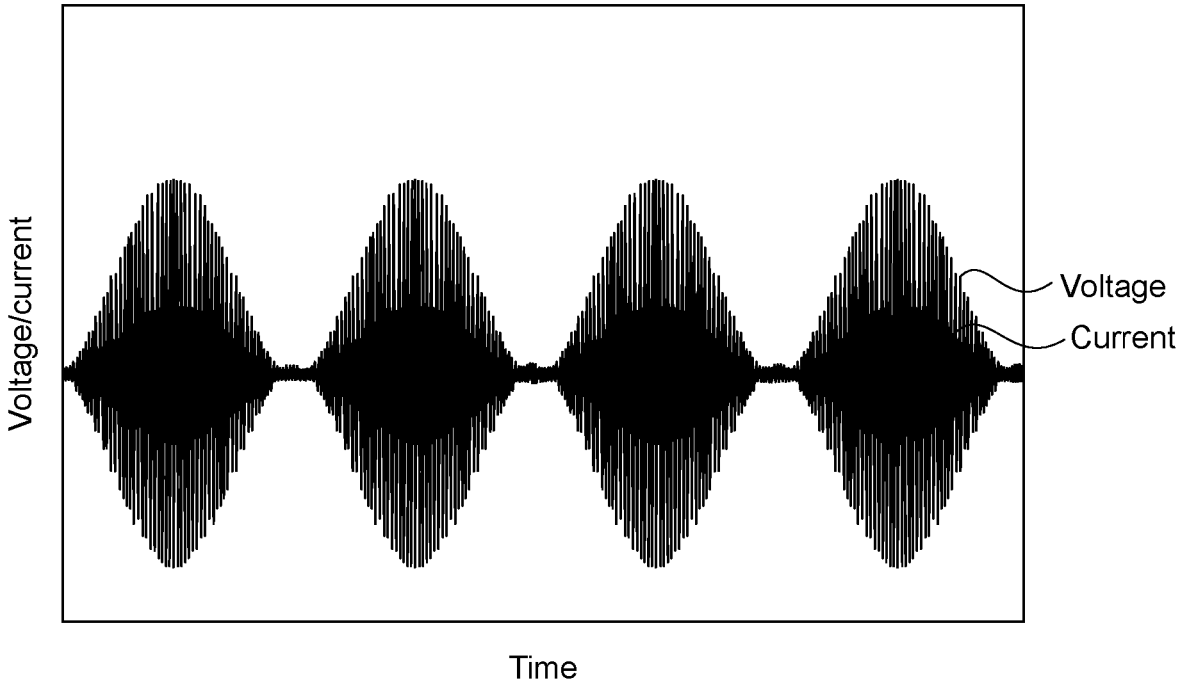
FIG. 5 shows an amplitude-modulated wave waveform generated by the driving apparatus provided in the vibration generating apparatus.
Figure 6:
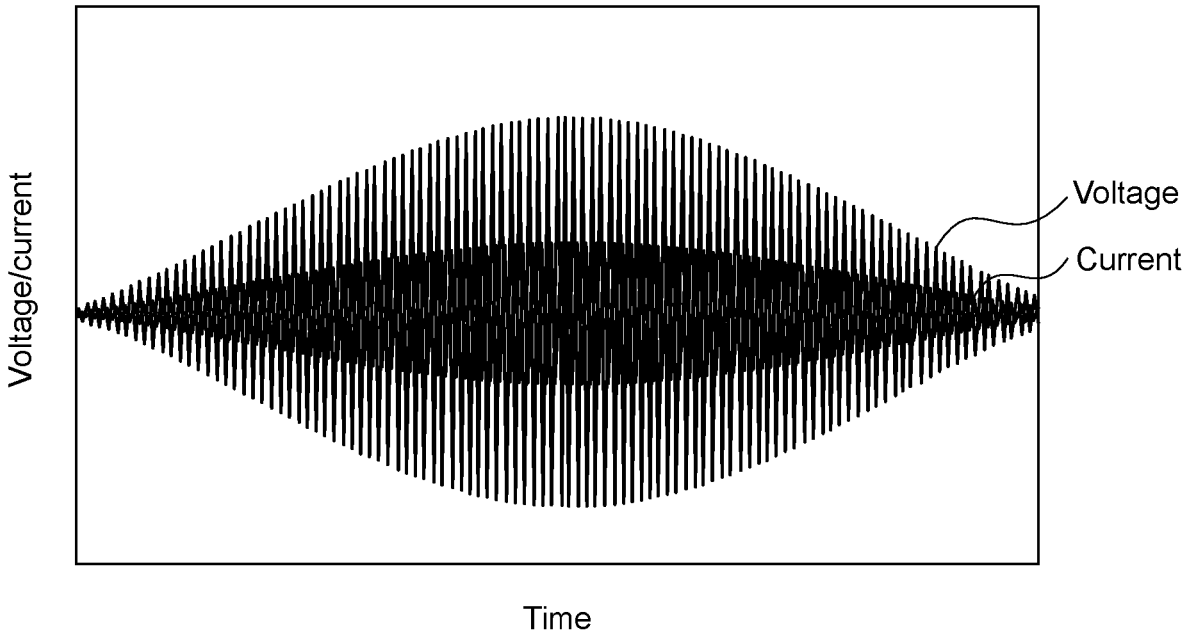
FIG. 6 shows a waveform of the amplitude-modulated wave shown in FIG. 5 in an enlarged state.

FIG. 5 shows a voltage waveform and a current waveform including a waveform of an amplitude-modulated wave obtained by modulating the amplitude of the sine wave in the high-frequency region with a modulating wave as which the sine wave in the low-frequency region (signal wave) is used. FIG. 6 is an enlarged diagram of FIG. 5. When the voltage waveform shown in FIG. 5 is applied as the driving signal to each of the piezoelectric actuators 102 from the driving apparatus 103, current having the current waveform shown in FIGS. 5 and 6 flows.

Figure 7:
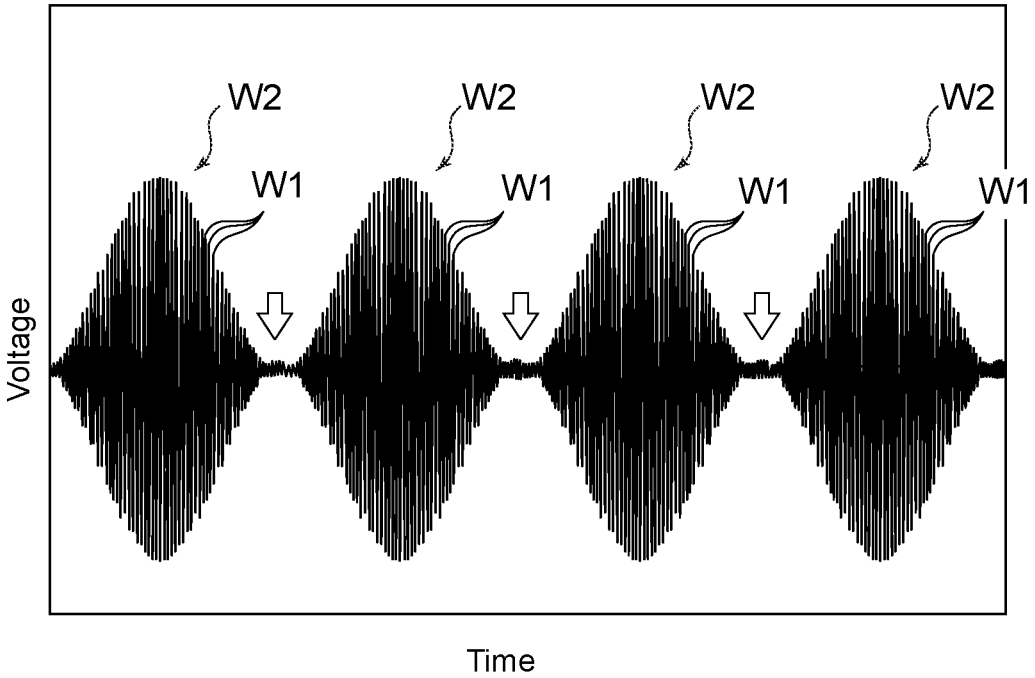
FIG. 7 shows an amplitude-modulated wave waveform (voltage waveform only) generated by the driving apparatus provided in the vibration generating apparatus.
Figure 8:
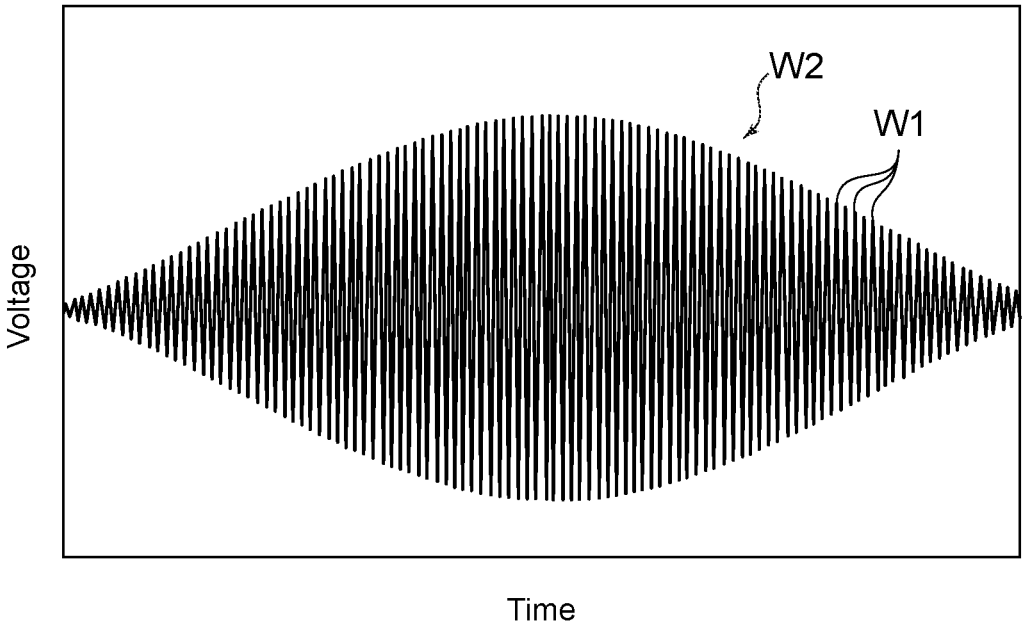
FIG. 8 shows a waveform of the amplitude-modulated wave shown in FIG. 7 in an enlarged state.

FIG. 7 shows only the voltage waveform shown in FIG. 5 and FIG. 8 shows only the voltage waveform shown in FIG. 6. A wave having a smaller wavelength, which is indicated by W1 in FIGS. 7 and 8, is the sine wave in the high-frequency region and a wave having a larger wavelength, which is indicated by W2, is the sine wave in the low-frequency region. Hereinafter, the sine wave in the high-frequency region will be referred to as a high-frequency wave W1 and the sine wave in the low-frequency region will be referred to as a low-frequency wave W2.

In the waveform shown in FIGS. 7 and 8, the low-frequency wave W2 is formed as changes in amplitude of the high-frequency wave W1, i.e., the waveform shown in FIGS. 7 and 8 is an amplitude-modulated wave having the high-frequency wave W1 as a carrier wave and having the low-frequency wave W2 as a modulating wave. It should be noted that the high-frequency wave W1 has a frequency of 20 kHz or more and 40 kHz or less and the low-frequency wave W2 has a frequency of 10 Hz or more and 250 Hz or less.

Figure 9:
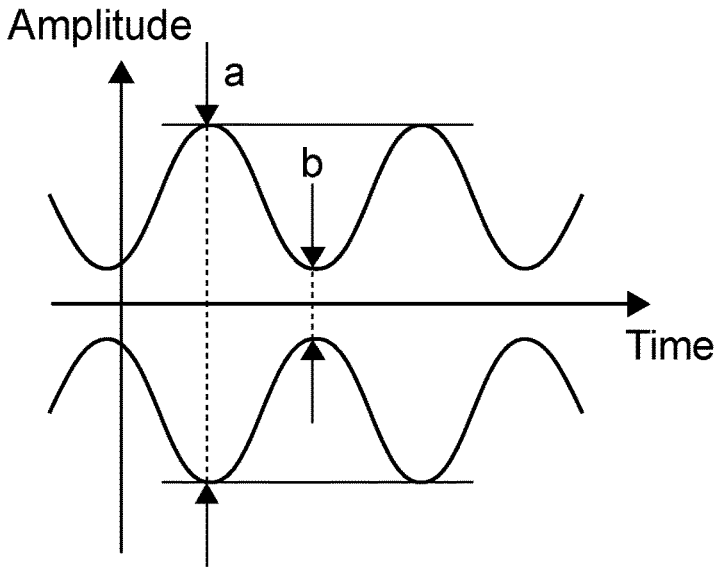
FIG. 9 is a schematic diagram showing amplitudes of the amplitude-modulated wave.

The voltage gain of the high-frequency wave W1 is favorably −10 dB or more and 0 dB or less and the voltage gain of the low-frequency wave W2 is favorably −6 dB or more and 0 dB or less. FIG. 9 is a schematic diagram showing a relationship between the waveform of the amplitude-modulated wave and the voltage gain. Assuming that as shown in the figure, the amplitude of the "peak" of the amplitude-modulated wave is represented as an amplitude a and the amplitude of the "valley bottom" is represented as an amplitude b, the degree of modulation m is expressed by the following Equation (1). As shown in the following Equation (1), as the amplitude b becomes lower relative to the amplitude a, the degree of modulation m becomes higher.

$$m=(a-b)/(a+b) \quad \text{Equation (1)}$$

Also in FIG. 7, when the voltage gain of the low-frequency wave W2 is increased, the "valley bottom" of the low-frequency wave W2 is deeper, and when the voltage gain of the low-frequency wave W2 is set to 0 dB, the amplitude of the "valley bottom" is minimum as indicated by the white arrows in FIG. 7. Moreover, when the voltage gain of the low-frequency wave W2 is reduced to be closer to −6 dB, the "valley bottom" of the low-frequency wave W2 is shallower and the amplitude is larger. When the voltage gain of the low-frequency wave W2 is further reduced to be closer to −10 dB, the amplitude b of the "valley bottom" of the low-frequency wave W2 is equal to the amplitude of the "peak" and the "valley" is not formed.

In this embodiment, the voltage gain of the high-frequency W1 and the low-frequency W2 is adjusted to a range in which the "valley" is formed. Specifically, the voltage gain of the high-frequency wave W1 is favorably −10 dB or more and 0 dB or less and the voltage gain of the low-frequency wave W2 is favorably −6 dB or more and 0 dB or less. Moreover, the voltage gain of the high-frequency wave W1 is more favorably −10 dB and the voltage gain of the low-frequency wave W2 is more favorably 0 dB.

When the driving apparatus 103 outputs the driving signal having the voltage waveform of the amplitude-modulated wave shown in FIG. 7 to each of the piezoelectric actuators 102, standing waves due to the high-frequency wave W1 are formed in the vibrating member 101 by the piezoelectric actuators 102 and a levitation phenomenon occurs. Furthermore, a vibration that stimulates receptors such as Meissner's corpuscles and Pacinian corpuscles is generated in the vibrating member 101 due to the low-frequency wave W2.

With this configuration, when the user touches the vibrating member 101 with a finger, the low-frequency wave W2 sensitively presents a tactile sense to the finger. Moreover, when the user presses the finger against the vibrating member 101, the user receives a squeeze effect due to the levitation phenomenon and also receives a strong low-frequency vibration. The user thus feels a totally new tactile sense.

Furthermore, since the amplitude of the high-frequency wave W1 is modulated, the current average of the entire waveform is reduced as compared to a case where the amplitude of the high-frequency wave W1 is not modulated, and it is possible to reduce the power consumption and heat generation. In addition, although noise may be generated between the user's finger and the vibrating member 101 in a case where the sine wave in the high-frequency region as shown in FIG. 3 is used as the driving signal, it is possible to prevent the generation of such noise in the case of the amplitude-modulated wave shown in FIG. 7.

EXAMPLE

The vibration generating apparatus according to the above-mentioned embodiment was manufactured, and the apparent power was measured when the driving signal having the voltage waveform of the amplitude-modulated wave shown in FIG. 7 was output from the driving apparatus to the piezoelectric actuator. Table 1 shows a gain ratio, a peak-to-peak voltage (Vpp), a voltage effective value (rms), current, and apparent power.

TABLE 1

| | Gain ratio 25 kHz · 100 Hz | Vpp [V] | rms [V] | Current [A] | Apparent power [V · A] |
|---|---|---|---|---|---|
| 1 | −10 dB · −10 dB | 15.5 | 5.5 | 0.506 | 2.8 |
| 2 | −10 dB · −6 dB | 15.5 | 5.5 | 0.473 | 2.6 |
| 3 | −10 dB · −3 dB | 15.5 | 5.5 | 0.410 | 2.2 |
| 4 | −10 dB · −0 dB | 15.5 | 5.5 | 0.400 | 2.2 |

The gain ratio refers to a ratio of the voltage gain of the high-frequency wave W1 and the voltage gain of the low-frequency wave W2. The high-frequency wave W1 was set to have a frequency of 25 kHz and the low-frequency wave W2 was set to have a frequency of 100 Hz. As shown in Table 1, the voltage gain of the high-frequency wave W1 was set to −10 dB, the voltage gain of the low-frequency wave W2 was varied between −10 dB to 0 dB, and the apparent power at a predetermined input voltage (rms of 5.5 V) was measured.

Figure 10:
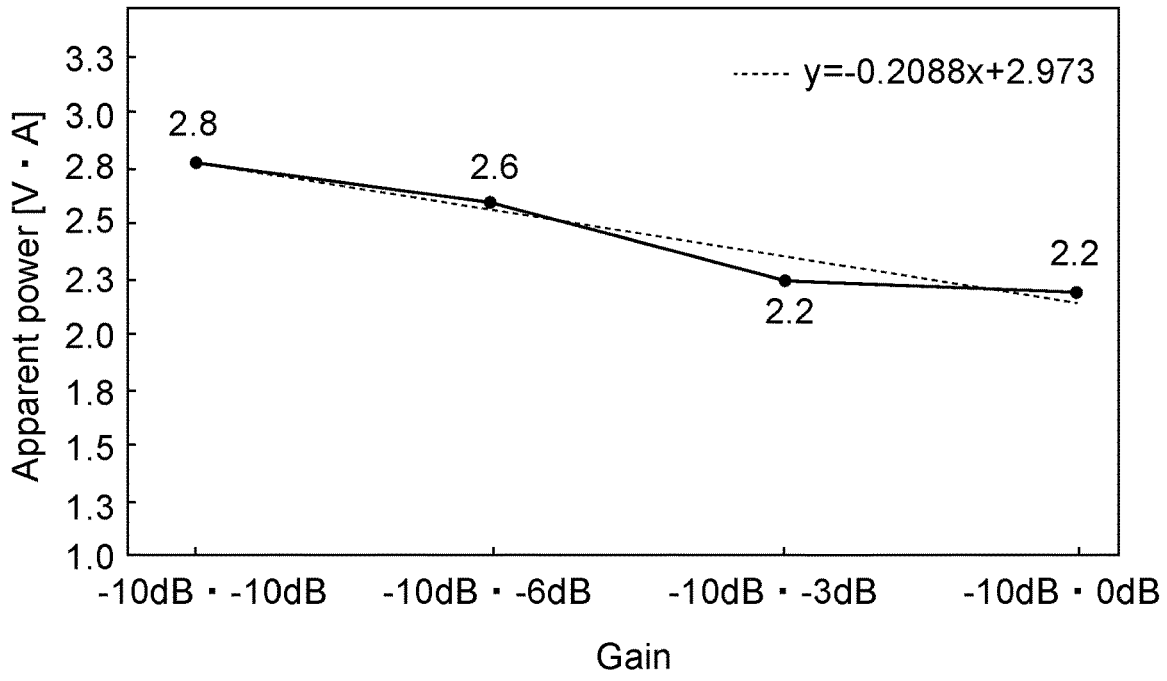
FIG. 10 is a graph showing a relationship between a gain ratio of high- and low-frequency waves and apparent power according to an example of the present disclosure.

FIG. 10 is a graph showing a relationship between the gain ratio and the apparent power. As it can be seen from the figure, the apparent power decreases when the voltage gain of the low-frequency wave W2 is made closer to 0 dB from −10 dB. Therefore, it is possible to reduce the power consumption by setting the voltage gain of the low-frequency wave W2 to be higher than the voltage gain of the high-frequency wave W1.

While the embodiment of the present disclosure has been described, the present disclosure is not limited to the embodiment described above, and it should be appreciated that the present disclosure may be variously modified.

100 vibration generating apparatus
101 vibrating member
102 piezoelectric actuator
103 driving apparatus

What is claimed is:

1. A vibration generating apparatus comprising:

a vibrating member;

a piezoelectric actuator bonded to the vibrating member; and a driving apparatus that sets a signal wave in a low-frequency region having a frequency of 10 Hz or more and 250 Hz or less as a modulating wave and outputs to the piezoelectric actuator a driving signal having a waveform obtained by modulating an amplitude of a sine wave in a high-frequency region having a frequency of 20 kHz or more and 40 kHz or less with the modulating wave, thereby causing the vibrating member to vibrate via the piezoelectric actuator driven by the driving signal.

2. The vibration generating apparatus according to claim 1, wherein:

the sine wave is set to have voltage gain of −10 dB or more and 0 dB or less and the modulating wave is set to have voltage gain of −6 dB or more and 0 dB or less.

3. The vibration generating apparatus according to claim 2, wherein:

the sine wave is set to have voltage gain of −10 dB, and the modulating wave is set to have voltage gain of 0 dB.

4. An electronic apparatus comprising:

the vibration generating apparatus as set forth in claim 1; and an electronic component connected to the vibration generating apparatus.

* * * * *